United States Patent [19]

Rudy

[11] 4,101,318

[45] Jul. 18, 1978

[54] CEMENTED CARBIDE-STEEL COMPOSITES FOR EARTHMOVING AND MINING APPLICATIONS

[76] Inventor: Erwin Rudy, 1575 NW. Oakhill Dr., Beaverton, Oreg. 97005

[21] Appl. No.: 749,343

[22] Filed: Dec. 10, 1976

[51] Int. Cl.[2] ..... C22C 29/00; B22F 3/00

[52] U.S. Cl. ..... 75/240; 75/241; 75/200; 75/203; 75/204; 164/57

[58] Field of Search ..... 75/200, 203, 204, 240, 75/241; 164/57

[56] References Cited

U.S. PATENT DOCUMENTS

| | | | |
|---|---|---|---|
| 3,790,353 | 2/1974 | Jackson et al. | 75/240 |
| 3,840,367 | 10/1974 | Rudy | 75/240 |

OTHER PUBLICATIONS

Schuster et al., "Monatshefte fur Chemie", vol. 107, #5, Sep./Oct. 1976, pp. 1167–1176.

*Primary Examiner*—Brooks H. Hunt
*Attorney, Agent, or Firm*—Ronald W. Reagin

[57] ABSTRACT

A composite structure is disclosed which comprises a combination of heat treatable cemented carbides and alloy steel. The carbide phase in the cemented carbide is predominantly tungsten monocarbide, or solid solutions of tungsten monocarbide and molybdenum monocarbide, of stoichiometric composition. The binder in the cemented carbide is based on heat treatable low to medium alloy steel and contains less than 1.5 percent by weight vanadium and less than 8 percent by weight chromium. A method for making the cemented carbide is also disclosed. The composite structure is formed by integral casting in steel of the preformed cemented carbide. The composite structure can be heat treated to the desired hardness and toughness properties. The primary area of application of the composites of the invention are in digger teeth for earthmoving, in mining and ore-comminution tools, and in cutter heads for deep-well drilling.

13 Claims, 17 Drawing Figures

APPROXIMATE LOWER TEMPERATURE LIMITS FOR $\eta$-CARBIDE FORMATION IN STEEL-BONDED TUNGSTEN-MOLYBDENUM MONOCARBIDE ALLOY AS A FUNCTION OF THE MoC CONTENT IN THE CARBIDE AND AT DIFFERENT CHROMIUM LEVELS IN THE BINDER APPROXIMATE LOWER TEMPERATURE LIMITS FOR $\eta$-CARBIDE FORMATION IN STEEL-BONDED TUNGSTEN-MOLYBDENUM MONOCARBIDE ALLOY AS A FUNCTION OF THE MoC CONTENT IN THE CARBIDE AND AT DIFFERENT CHROMIUM LEVELS IN THE BINDER a | b a | b | c | d a b c a b

CEMENTED CARBIDE-STEEL COMPOSITES FOR EARTHMOVING AND MINING APPLICATIONS

The present invention relates to composites comprising a heat treatable tungsten carbide-based cemented carbide component and a heat treatable steel component which are particularly useful for earthmoving and mining applications. The composites of the invention are fabricated by integral casting of the cemented carbide in steel.

Those skilled in the art are familiar with the tools and implements of earthmoving operations, such as scraping, ripping, trenching, dredging, surface mining, etc. Typical modern earthmoving equipment has replaceable wear tips, also referred to as digger teeth, on the ground-engaging part of the machinery. The digger teeth are subjected to abrasive wear as movement of the tool forces ground material to flow under varying pressure along the surfaces of the wear tips. In addition to purely abrasive wear, the tips may also be exposed to high mechanical shock loads if digging is performed in ground with gross inhomogenization with respect to size and consistencies of the constituent, such as the presence of large rocks in ordinary soil.

Useful wear life of the digger teeth depends on many factors, and may extend from several hundred hours down to minutes in cases where a combination of hard and highly abrasive material and high operating temperatures cause rapid attrition of the wear tip by macroscopic chip removal of the ground-engaging surfaces. The high cost of such operations has promoted extensive work to improve, by many different means, the productive wear life of the wear tips.

It is well-known that increased hardness of steel will improve wear resistance. However, difficulties in fabrication, and intrinsic metallurgical limitations of low alloy steel with respect to hot hardness, coupled with a disproportionate loss in toughness with increasing hardness when compared with the moderate gain in wear resistance above Rockwell hardness levels of $R_c \sim 55$, has put practical limits to these developments. Consequently, as a necessary compromise between the combination of required properties. The hardness levels of commercial digger teeth are usually held in the range from $R_c$ 48 to 52.

The enormous cost in terms of labor and raw materials consumed in earth moving and mining operations have caused those skilled in the art to seek new approaches in this problem to find better ways to increase the life and wear resistance of the equipment. One area which has been extensively investigated is the use of carbides to increase wear resistance. Carbides are known to be much harder than steel and to have superior wear resistance properties, and these characteristics of carbides has been widely exploited in other areas, such as in machine tools.

One widely used means for improving the wear life of earthmoving and mining tools by use of carbides is hard facing. In this method, a wear resistant layer, typically consisting of dispersions of chromium carbides or tungsten carbides in ferrous metal alloys are applied to the steel surface of consumable electrode welding. The carbide-containing facings are, however, quite brittle and have a tendency to spall when subjected to sudden mechanical loads. Other commonly used hard facings on steel include dispersions of grains of cast WC + $W_2C$ eutectic, or crushed WC-Co cemented carbide alloys, in low melting alloy matrices, such as manganese bronze. The low hardness of these matrix alloys prevents their use in applications other than in purely abrasive conditions.

A disadvantage common to all hard facings results from the fact that heat applied during the application decreases the hardness, and thus strength and wear resistance of the steel substrate and the thermomechanical and metallurgical properties of the hardfacing generally precludes heat treatment of the composite wear tip following the hardfacing operation.

The high hardness and wear resistance of transition metal carbides, and the availability of comparatively high strength carbide-containing alloys with the advent of sintered cemented carbides have prompted extensive interest in their use for improving the wear life of tools used in the mining industry. Of the large number of different metal carbides known, tungsten carbide exhibits the best resistance to mineral wear, and WC-Co alloys are presently widely used in hard rock mining (see, for instance, R. Kieffer and F. Benesovsky: Hartstoffe and Hartmetalle, Wien, Springer, 1965). The cemented carbide in the form of preformed inserts of the desired shape, is usually joined to the steel component by brazing and the tool geometry is designed such as to avoid exposure to the carbide as well as the brazed interface, to substantial tensile loads during use.

The brittleness and thermal shock sensitivity, coupled with the low melting temperatures of the brazing alloy and the large thermal expansion difference between carbide and steel, prevents a hardening of the steel component in the composite tool, thus necessitating careful design of the tool geometry to prevent excessive wear of the steel support.

While the tool geometry in hard rock mining applications such as percussive or rotary drilling, is conducive for the use of conventional tungsten carbide-cobalt binder alloys, permissible tool geometries in typical earthmoving operations, such as scraping or ripping, are generally unfavorable. The wear tips are exposed to high operating stresses and mechanical shock, and the critical wear surfaces are mostly under tensional stresses. Higher cobalt binder contents improve the toughness of the cemented carbide, but decreasing wear resistance, as well as fabrication problems, sets a practical upper limit for the binder content at approximately 30 weight percent.

These factors combined with the high cost of the machining and brazing operation, the limitations imposed by the differential thermal expansion between steel and cemented carbide on the size of the carbide parts, as well as the inability to heat treat the brazed carbide-steel composite, have virtually prevented the use of conventional cemented carbide alloys for improving the wear life of digger teeth.

Considerable work has been done in the past to investigate binders for carbides other than cobalt. The idea of hardenable steel binders, or of stellites, in places of cobalt in WC-Co alloys was pursued soon following the initial developments of cemented carbides (compare, for example, the compilation in R. Kieffer and F. Benesovsky, reference cited). These developments, concentrating mainly on compositions with low binder contents for metal cutting, resulted in very brittle and low strength alloys which proved unsuitable for the intended applications. The brittleness of the cemented carbides with binders containing substantial amounts of iron was traced to the formation of double carbides of the general formulation $(M,M')_6C$ and $(M,M')_{12}C$, in which M stands for a group VI metal, such as tungsten, and M' for an iron group metal. These double carbides are commonly known as $\eta$-carbides and form a common constituent in higher alloy tool steels.

In view of the difficulties encountered in cementing tungsten carbide with iron base binders, the prior art concentrated mainly on such alloys in which the nature of the alloying elements precluded the formation of these undesirable carbides. Carbide alloys studied include such solid solutions as (Ti,W)C, TiC-$Mo_2C$, TiC-VC, and VC-WC (see Austrian Pat. No. 163611), but the first useful alloy resulting from these developments are based on TiC as carbide component. These alloys (see U.S. Pat. Nos. 2,753,261 and 2,828,202) are widely used as wear components in punching and forming dies, and have the further advantage over conventional carbides that they are machinable in the annealed condition. Further work to replace TiC by other carbides also known not to form $\eta$-carbides when combined with iron-based binders have not been successful. However, in terms of wear resistance against mineral materials, all cubic carbides, such as TiC, VC, etc., as well as the cubic monocarbide solid solutions such as (Ti,W)C, (Ti,Mo)C, are inferior to hexagonal tungsten or molybdenum monocarbide to a degree which would preclude their economic use as wear components for earth moving or mineral tools. Thus, these materials have never found practical use in earthmoving or mining tools.

It is accordingly an object of the present invention to provide means by which the superior wear resistance properties of cemented carbides can be economically employed in earthmoving and mining tools.

It is a further object of the present invention to provide a composite comprising a heat treatable cemented carbide component and a steel component, which, when formed by joining the preformed cemented carbide component to the steel component by integral casting, will yield a wear-resistant, tough laminate eminently suited for wear tips in earth moving and mining applications.

It is another object of the present invention to provide a composition of material based on steel-bonded tungsten monocarbide, or solid solutions (Mo,W)C, which, when joined with low alloy steel or tool steel by integral casting, will yield a high strength and wear-resistant composite eminently suited as wear tips in earthmoving and mining tools.

It is yet another object of the present invention to provide a method of making a composition of material based on tungsten monocarbide, or solid solutions (Mo,W)C, cemented with steel alloys, which when manufactured according to the method of the present invention has high strength, toughness and abrasion resistance and will respond to heat treatment in the same manner as common alloy steels.

Briefly stated and in accordance with the presently preferred embodiment of the invention, a heat treatable composite structure comprising a heat treatable cemented carbide component and a heat treatable steel component is provided. The cemented carbide component comprises a sintered component including grains of monocarbide based substantially on the hexagonal solid solution (Mo,W)C embedded in a binder of heat treatable steel alloy, with the binder being from 30 to 80 percent by volume of the cemented carbide component. The steel component of the treatable composite structure is formed from a castable low alloy steel. The preformed cemented carbide component is joined to the steel component by placing the cemented carbide component having the desired geometry in a selected location of a casting mold, and pouring molten steel into the mold assembly so as to form, after solidification, a composite in which the cemented carbide component is integrally bonded to the steel component by diffusion bonding and is prestressed into compression as the steel component solidifies around the cemented carbide component. The cemented carbide-steel composite is then heat treated according to the practices employed for the steel component for the purpose of attaining the desired hardness and toughness properties, and the heat treated component is used as a wear component in a earthmoving or mining tool. The cemented carbide, the amount and geometry of which is selected according to their requirements of a specific application, serves the express purpose of prolonging the wear life of the steel components.

In accordance with another aspect of the present invention, a composition of material is provided which comprises sintered carbide-binder metal alloys which has the desired hardness and toughness properties for use in earthmoving or mining tools and which has the ability to withstand the thermal shock of being integrally cast into the steel component and which can further stand heat treatment according to the practices employed in the industry to impart the desired characteristics to the steel component to which the carbide component is integrally bound. The composition of material comprises sintered carbide-binder metal alloys in which the carbide comprises grains of monocarbide based substantially on the hexagonal solid solution (Mo,W)C embedded in a binder of heat treatable steel alloy which contains between 0.40 and 8.0 percent by weight chromium, between 0.40 and 8.0 percent by weight of a metal selected from the group consisting of molybdenum and tungsten, less 1.5 percent by weight vanadium and between 0.15 and 1.20 percent by weight carbon, with the binder metal being from 40 to 80 percent by volume of the compositon of material.

In accordance with yet another aspect of the present invention, a method of making the above-described composition of material is provided which allows the material to be sintered to substantially full density while avoiding the formation of undesirable $\eta$-carbides. In accordance with the method of the invention, a powder mixture of binder and carbides having the desired gross composition is first prepared in which the binder portion of the powder mixture comprises iron powder whose average diameter is less than 40 micrometers alloyed with up to 10 weight percent other iron group elements (nickel and cobalt) and not more than 0.2 weight percent vanadium and 1.5 weight percent chromium. Any additional chromium and vanadium desired in the binder portion of the mixture is added to the powder mixture as carbides, and the molybdenum and tungsten components of the binder mixture are added as either elemental powders or carbides. The powder mixture is then wet milled to increase the sintering activity of the iron powder, and is then dried and homogenized. The powder mixture is then pressed into compacts having the desired shape and is then sintered to substantially full density at sintering temperatures not higher than the temperature at which $\eta$-carbides are formed for the particular solid solution (Mo,W)C.

For a complete understanding of the invention together with an appreciation of its other objects and advantages, please see the following detailed description of the attached drawings, in which:

FIG. 1 is a graph showing the lower temperature limits for $\eta$-carbide formation in steel-bonded tungsten — molybdenum monocarbide alloy as a function of the MoC content in the carbide and at different chromium levels in the binder, and also shows the practical minimum sintering temperature for complete densification.

FIGS. 2*a* and 2*b* are microstructures of a steel-bonded tungsten carbide sintered at 1295° C (2*a*) and 1255" C (2*b*), the sintered alloy having the gross composition 0.68 moles $(Fe_{.95}Cr_{.025}Mo_{.025})C_{.029}$ and .32 moles of WC. FIG. 2*a* shows the formation of large islands of brittle $M_{6\text{-}12}C$ ($\eta$-carbide) phase at a magnification of 1000 when the chosen sintering temperature is too high, while the micrograph in FIG. 2*b* reveals only WC at the correct sintering temperature of 1255° C.

FIG. 3 is a graphical presentation of the transverse rupture strengths of steel-bonded group VI metal carbide alloys as a function of the sintering temperature. The samples referred to in FIG. 3 were heat treated by oil quenching from 1050° C followed by a one-hour temper at 500° C and had the following gross composition:

Sample A: .31 moles $(Mo_{.5}W_{.5})C$ and .69 moles $(Fe_{.93}Cr_{.025}Mo_{.025}Ni_{.02})C_{.0292}$ Sample B: .31 moles WC and .69 moles $(Fe_{.93}Cr_{.025}Mo_{.025}Ni_{.02})C_{.0292}$ Sample C: .31 moles WC and .69 moles $(Fe_{.89}Cr_{.025}Mo_{.025}Co_{.05}Ni_{.01})C_{.0292}$ FIG. 4 is a graphical presentation of the transverse rupture strengths of a steel-bonded tungsten carbide alloy as a function of the tempering temperature, the carbide having a gross composition of 0.33 moles WC and 0.67 moles $(Fe_{.95}Cr_{.032}Mo_{.018})C_{.0215}$.

Figure 8:
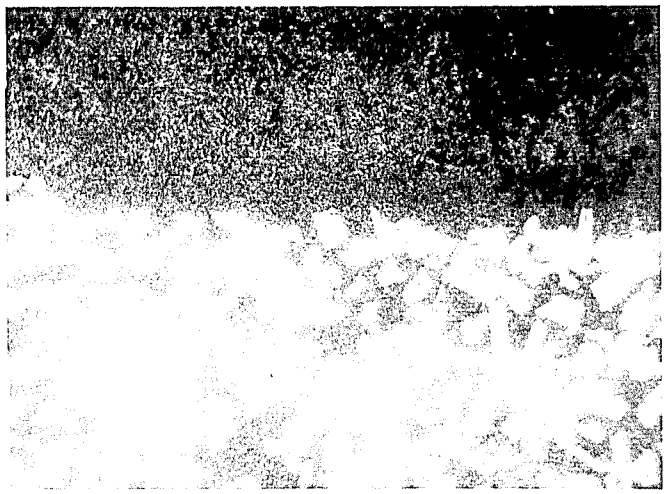

FIG. 8 is a micrograph of the interface of steel-bonded tungsten carbide integrally cast into low alloy steel in the fully heat treated and tempered condition of a magnification of 400. Zone A in FIG. 8 is a low alloy steel with 2% nickel and .25% carbide and has a Rockwell C hardness of 50. Zone B in FIG. 8 is the interdiffusion zone between steel and the steel-bonded carbide with a measured Rockwell C hardness of 69.

Figure 9:
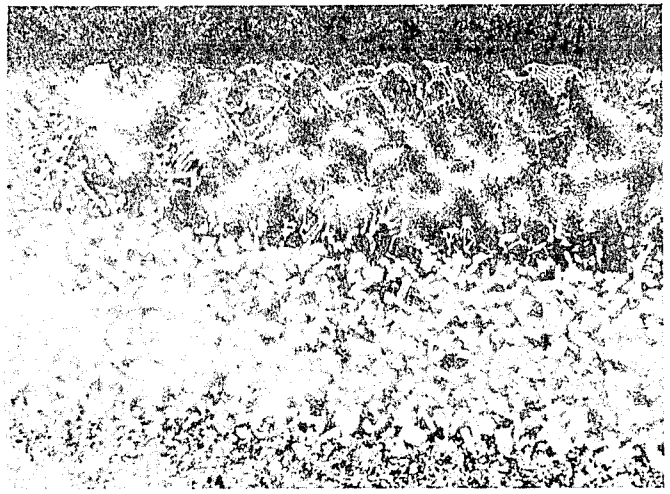

FIG. 9 is a micrograph of the steel/cemented carbide interface of a steel-bonded tungsten carbide integrally cast into steel and depicts the formation of Ledeburite eutectic at excessive casting temperatures. The magnification of the micrograph depicted in FIG. 9 is 160 times; Zone A shows the unaffected low alloy steel; Zone B, primary steel grains surrounded by Ledeburite eutectic; Zone C, the interdiffusion zone steel/cemented carbide; and Zone D, the unaffected cemented carbide.

Figure 10:
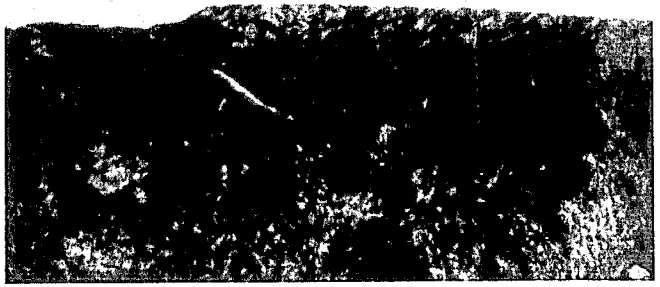

FIG. 10 is a micrograph of a magnification of 600 times showing the interface between steel-bonded tungsten carbide and low alloy steel of a composite formed by resistance welding. The light area of the micrograph of FIG. 10 shows the cemented carbide and the dark area the low alloy steel in heavily etched condition.

Figure 11:
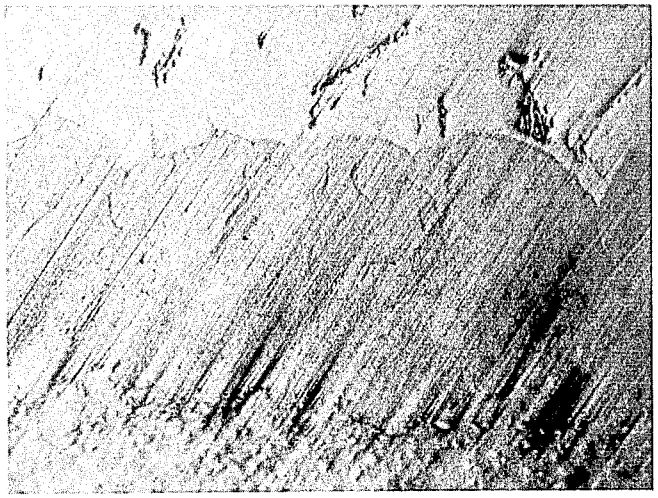

FIG. 11 is a micrograph of the steel/cemented carbide interface of a steel-bonded tungsten carbide which has been coated with a brazing alloy prior to integral casting in steel at a magnification of 500. Zone A in FIG. 11 depicts the cast steel, Zone B the layer of high temperature brazing alloy with an average layer thickness of 100 micrometers and a gross composition 65 weight percent Cu, 30 weight percent Ni and 5 weight percent Mn, and Zone C the steel-bonded tungsten carbide.

Figure 12A:
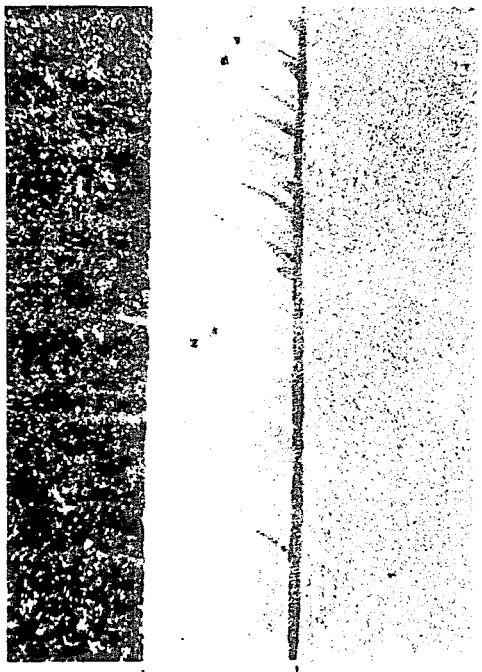
Figure 12B:
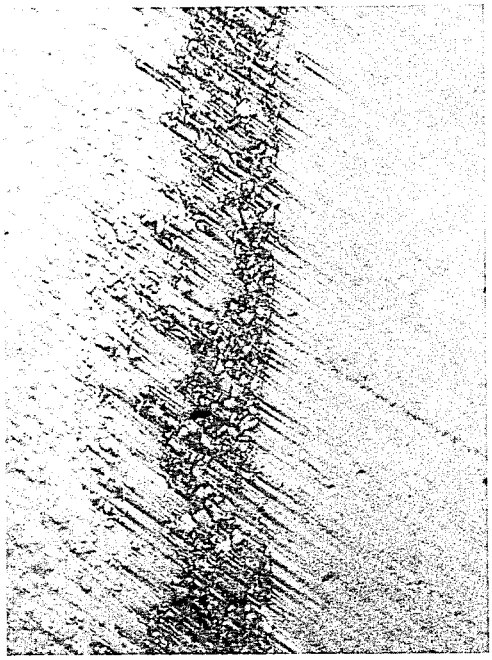

FIGS. 12*a* and 12*b* are micrographs of different magnifications of the steel/cemented carbide interface of a steel-bonded tungsten carbide which has been coated with a 1000 micrometer surface layer of high temperature brazing alloy prior to integral casting in steel. FIG. 12*a* depicts, at a magnification of 25, in Zone A the cast steel, in Zone B the layer of high temperature brazing alloy with a gross composition 78 weight percent Cu, 20 weight percent Ni, 2 weight percent Mn, and in Zone C the steel-bonded carbide. FIG. 12*b* depicts at a magnification of 600 times the microstructure at the cemented carbide/brazing alloy interface of the composite shown in FIG. 12*a*.

Figure 13:
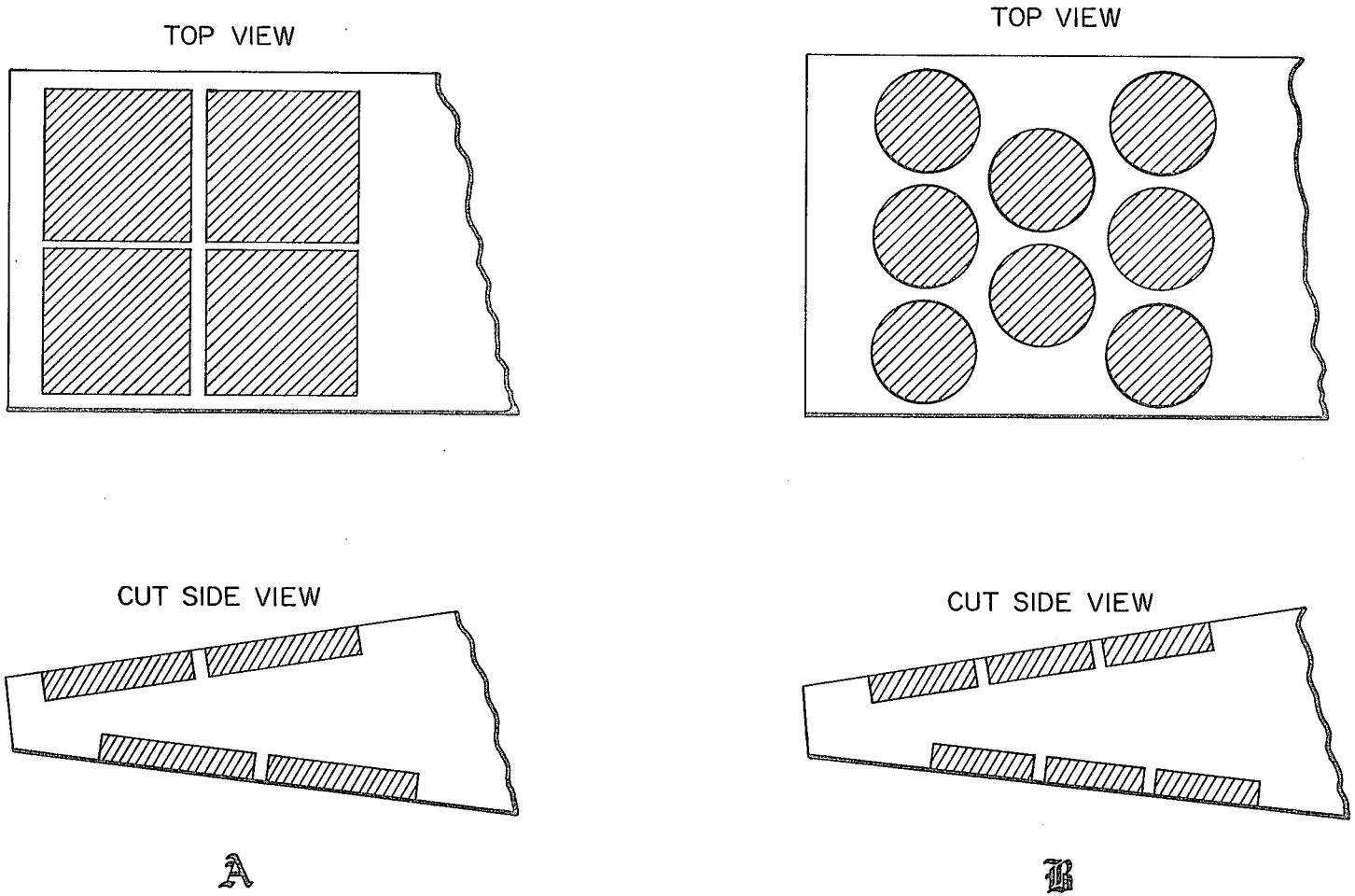

FIG. 13 is illustrations of preferred carbide coverages of steel digger teeth operating at high (> 70°) positive angles of attack in earthmoving applications. The integrally cast carbide inserts are shown cross-hatched.

Figure 14:
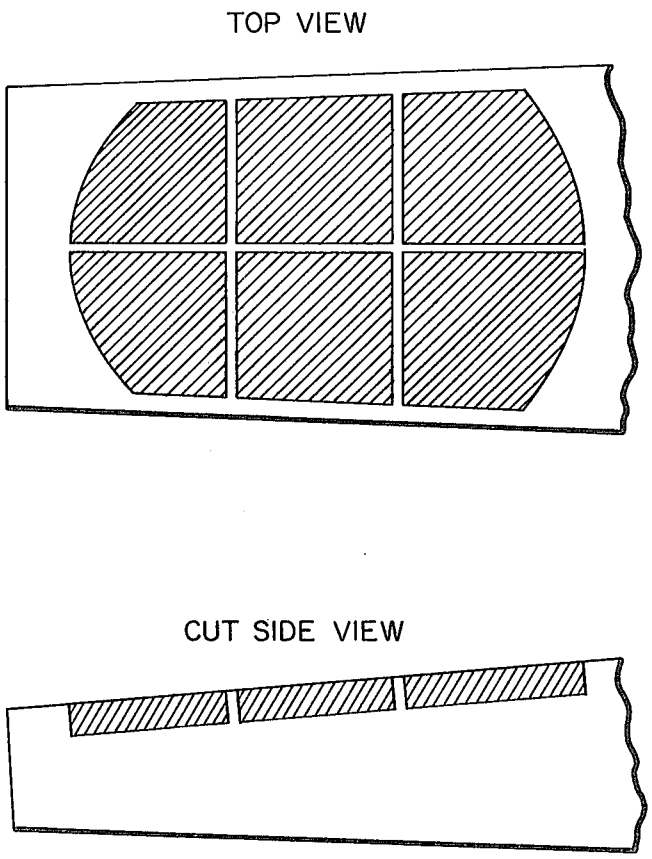
Figure 14:
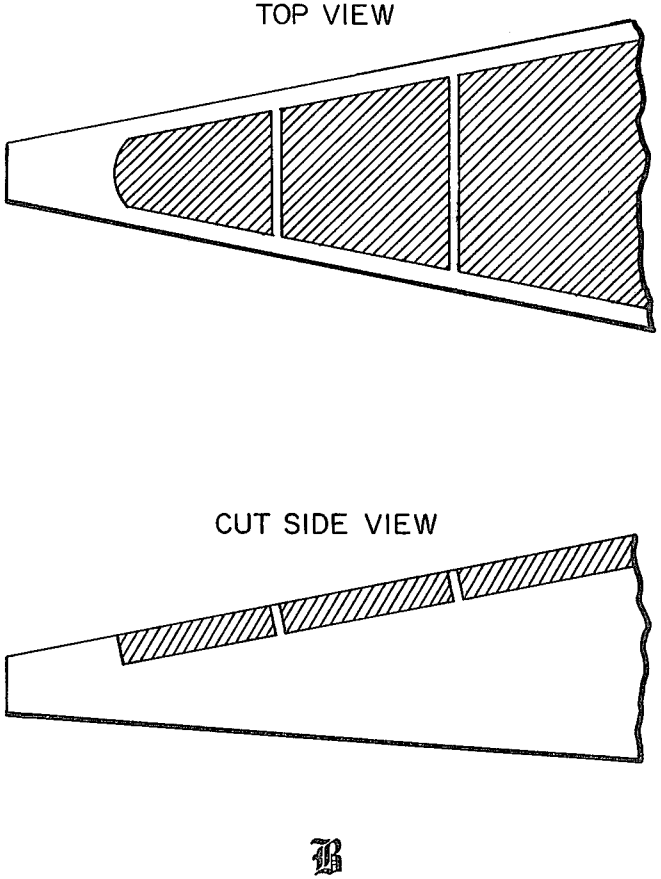

FIG. 14 is illustrations of preferred carbide coverages of steel digger teeth operating at angles of attack of less than +35 degrees. The integrally cast carbide inserts are shown cross-hatched.

Figure 15:
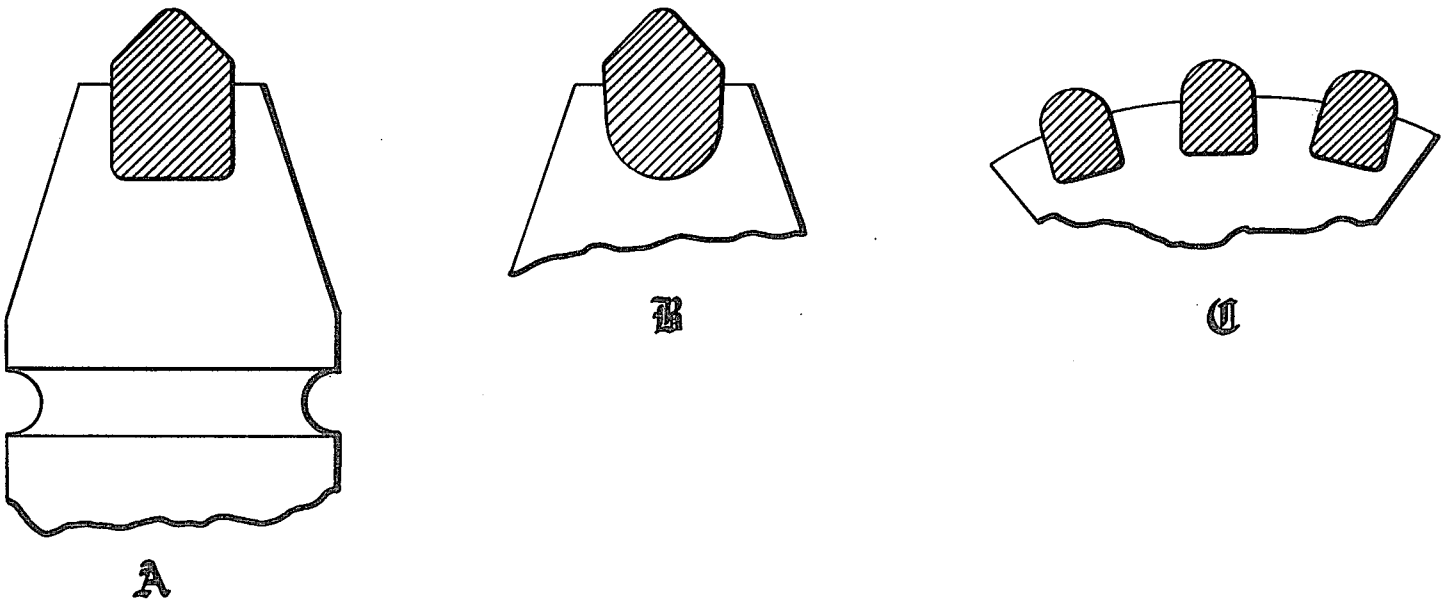

FIG. 15 is illustrations of integrally cast carbides in mining tools. The configurations denoted A and B in FIG. 15 are typical tools used in augers and coal miners, while C illustrates a section of a tricone drilling bit.

The gross compositions of the carbide and the steel component are preferably expressed in relative mole fractions in the form $(M_xM'_x, M''_x \ldots) C'_z$, in which M, M', M'' . . . stands for the metal components, and the stoichiometry parameters $z$ measures the number of gramatoms carbon per gramatom of the combined metal; the parameter $z$ thus provides a measure of the stoichiometry of the alloy with respect to carbide and a value of $z = 1$ defines the stoichiometric monocarbide. For simplicity, and to conform with the commonly accepted practice, the stoichiometry parameter is omitted if it equals the value 1. $x$, $x'$, $x''$ . . . are, respectively, the relative mole fractions (metal exchanges) of the metal constituents M, M', M'' . . . It is noted that $100x$ defines mole percent $MC_z$ or mole percent $MC_z$-exchange, $100.x''$ mole percent $M''C_z$ or mole percent $M''C_z$ exchange, etc.

This method of defining the overall composition is particularly useful in describing the concentration spaces of interstitial alloys and will be used, sometimes in conjunction with compositions given in weight percent of the individual component, throughout the remainder of this specification.

In preparing the cemented carbide component of the composites of the invention, it is imperative that, in order to avoid substantial conversion of the hexagonal monocarbide MC, (M = Mo,W) into $\eta$-carbides, or subcarbide of the general formulation $M_2C$, which would cause substantial deterioration of toughness and wear-resistance, of the alloy, sintering temperatures of the cemented carbide component of the composites of the invention have to be kept below 1285" C to 1150" C, dependent upon the level of the MoC in the carbide. The concentration levels of these elements in the binder which have a destabilizing effect on the hexagonal monocarbides of tungsten and molybdenum, such as chromium, also have to be kept below certain limits. The carbon balance of the binder, in conjunction with the other alloying elements present in the binder, also has a significant effect on alloy properties and sintering behavior, and has to be kept within certain defined limits in order to obtain the best compromise between fabricability, binder heat treatability and toughness, stability of the carbide phase.

In brief, the important alloying principles underlying the selection of alloy components and fabrication conditions under the chosen constraints regarding stability of the hexagonal monocarbide phase, heat treatability of the binder, and permissible range of melting temperatures dictated by the need for a high metallurgical bond when integrally cast in steel without degradation of carbide geometry properties, were determined experimentally to be the following:

Tungsten monocarbide forms a stable solid state equilibrium with iron, whereby an increasing amount of tungsten carbide is dissolved in the iron with increasing temperature. Owing to the high solubility of carbon in the austenitic steel, no free carbon is formed along the join WC + Fe, as the vertex of the three-phase equilibrium $$WC + C + (Fe_xW_y)C_x$$

at the iron-rich alloy $(Fe_xW_y)C_z$ gradually shifts to higher tungsten concentrations, i.e. the value $y$ increases, with increasing temperatures. The three phases equilibrium remains stable to about 1295° C at which temperature melting occurs along this join. The equilibrium involving the liquid phase intercepts at slightly higher temperatures the three-phase region $$(FeW)_{6\text{-}12}C(\eta\text{-carbide}) + WC + (Fe_{x'}W_{y'})C_{z'},$$

resulting in a progressively increasing conversion of undissolved tungsten carbide into $\eta$-carbide as the temperature is increased. According to the principles of phase equilibrium, the same sequence of phase equilibria should be traversed in reverse when the temperature is lowered, but in practice this is not found because the $\eta$-carbide, once formed, dissolved only extremely slowly and reestablishment of the true equilibrium condition at low temperatures generally is not possible within feasible length of time. In practice, therefore, the equilibrium $$(Fe_xW_y)C_z + WC \rightarrow \text{Liquid} + \eta\text{-carbide}$$

must be considered as irreversible, i.e. once the two-phase mixture on the left hand side had been exposed to sufficiently high temperature to effect a partial, or complete, conversion, to $\eta$-carbide, reformation of tungsten monocarbide from the $\eta$-carbide is generally not possible.

If the carbon content of the alloys is raised so that the gross composition of the alloy comes to lie substantially to the carbon side of the join Fe-WC, the incipient melting temperatures of the alloy drop and approach the melting temperatures of the binery Fe-C eutectic. In such alloys, the relative proportion of WC retained in the alloy exposed to a given temperature above incipient melting will be larger because tungsten monocarbide, rather than the $\eta$-carbide, becomes the primary crystallizing phase. However, the last product of crystallization in such alloys is Ledeburite eutectic, which generally form a fine-grained network of cementite and other carbides around the iron-rich metal grains, and causing the alloys to become very brittle. As a rule, the cementite lattice at the grain boundaries cannot be removed by prolonged solutioning or normalizing treatments at subsolidus temperatures.

Conversely, if the carbon contents of the iron-rich phase are adjusted such that the gross carbon content of the alloys comes to ie substantially below that determined by the join WC-Fe, then, depending on temperature, tungsten carbide content, and degree of carbon deficiency, partial or complete converstion of the tungsten carbide to $\eta$-carbide may occur even within the solid state region of the alloys.

Generally similar considerations hold true upon further alloying of ternary Fe-W-C by other elements, except that the temperatures at which particular reactions will occur may be significantly different from the purely ternary alloys. Because of the necessity for a certain amount of additional alloying of the iron to achieve the desired properties of the binder phases in the cemented carbides, it proved necessary to analyze in detail their effect in order to determine practical range of alloy compositions.

Molybdenum monocarbide, MoC, when alloyed with WC, causes a decrease in the stability of WC, but also lowers the incipient melting of the cemented carbides and therefore temperatures necessary to achieve densification. The upper practical limit for MoC is approximately 50 mole percent, as at higher molybdenum carbide concentrations even the minimum chromium content of 0.4 weight percent in the steel binder considered necessary for adequate hardenability, will result in the formation of detrimental quantities of $\eta$-carbide at 1150° C, which was found to be the lowest temperature at which complete densification could be achieved.

Substitution of up to 5 mole percent of TiC, HfC, NbC, and TaC for tungsten monocarbide caused a slight increase in the sintering temperatures and only a slight decrease in the transverse rupture strength of carbides, but the presence of second-phase cubic carbide due to their low solubility in WC resulted in a perceptible decrease of the wear-resistance in abrasive wear by $Al_2O_3$.

Substitutions of vanadium carbide for WC results in a rapid decrease in the incipient melting temperatures of the cemented carbide composition as the result of formation of a low melting metal + metal carbide eutectic. The formation of this eutectic appeared highly undesirable because of a rapid loss of shape of the sintered parts at temperatures slightly above those used in sintering and it also caused a significant impairment of the mechanical strength of the cemented carbide alloy.

Of the alloying additions which are preferably considered along with the binder, the element chromium has a pronounced destabilization effect on the hexagonal monocarbide, and a moderate destabilization effect on the $\eta$-carbide. At the optimum concentration levels of chromium in the binder phase, which be between 1.8 and 4.5 percent based on the weight of the binder, no significant formation of $\eta$- and $M_2C$ carbide is observed when the carbide is WC, and even at 6.5 weight percent chromium in the binder only insignificant quantities of $M_2C$ and $\eta$-carbide are found if the sintering temperatures are kept below 1260° C. The maximum permissible concentrations of chromium in the binder are progressively reduced upon increased substitution of tungsten carbide by molybdenum carbide. As an example, a binder alloy with 1.8 weight percent chromium and a carbon stoichiometry factor of $z = .025$, when combined with a monocarbide $(Mo_{.25}W_{.75})C$, must be sintered at temperatures less than 1215° C in order to avoid significant decomposition of the monocarbide.

Other alloying additions to the binder, notably molybdenum and tungsten in the form of the element powders mainly serve metal alloying and carbon balance in the binder.

In the prior art fabrication of powder metallurgical tool steels it is found necessary to choose sintering temperatures in the order of 1300° to 1350° C in order to attain full densification of the prealloyed and compacted powders during sintering. Commercially available powders of low alloy steel usually require sintering, or presintering under hydrogen to remove surface oxide, but even under conditions of reducing furnace atmospheres sintered parts usually show a certain amount of porosity after firing at temperatures as high as 1360° C.

Owing to the above described discoveries of the present invention concerning $\eta$-carbide formation in alloy combinations consisting of steel and tungsten-based monocarbides, such high sintering temperatures are not permissible and ways had to be found to permit complete consolidation of the powder mixtures at temperatures less than 1285° C. The preferred method of fabrication of the cemented carbides, which permits sintering of the green compacts to full density without incurring formation of detrimental quantities of $\eta$-carbide were determined to be as follows:

1. A powder mixture according to the desired gross composition is prepared from the ingredient powders consisting of tungsten monocarbide, or (Mo,W)C, iron, chromium carbide, molybdenum and tungsten and, if necessary for establishing the proper carbon stoichiometry $Mo_2C$ and $W_2C$. The initial mixture contains only about one-half of the required amount of iron to facilitate homogenization and comminution of selected addition metal carbides, in particular $Cr_3C_2$.

2. The initial powder mixture is wetmilled under an inert fluid such as naptha for about one-third of the total milling time, the balance of the iron powder added after the premilling period, and wetmilling continued for the remaining two-thirds of the milling cycle. This wetmilling is necessary to increase the sintering activity of the iron powder. Typical total milling times are between 48 to 85 hours in a ball mill, and between 8 and 14 hours in an agitated attritor mill.

3. A pressing aid such as paraffine is added to the powder slurry in the mill towards the end of the milling cycle. The milled powder slurry is discharged from the mill, dried and homogenized to achieved uniform distribution of the pressing aid. The powder is then precompacted and granulated to yield ready-to-press grade powder for fabrication of the cemented carbide.

Figure 1:
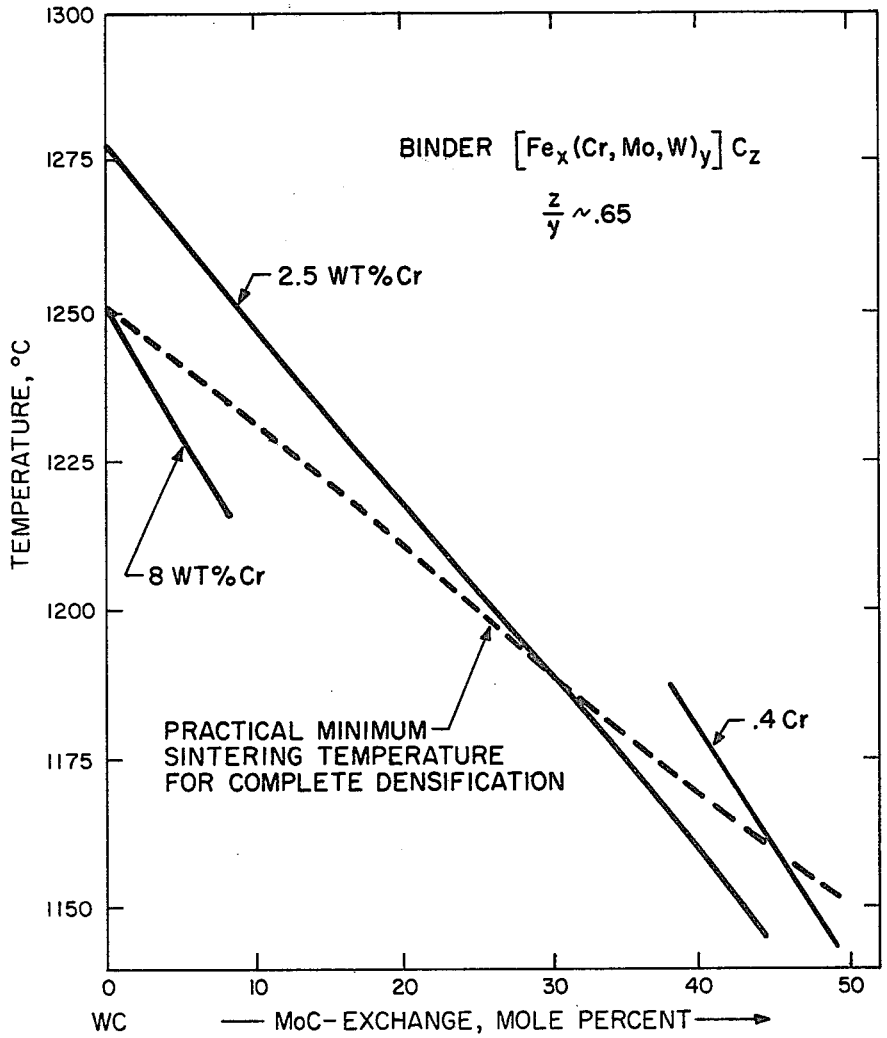
Figure 2A:
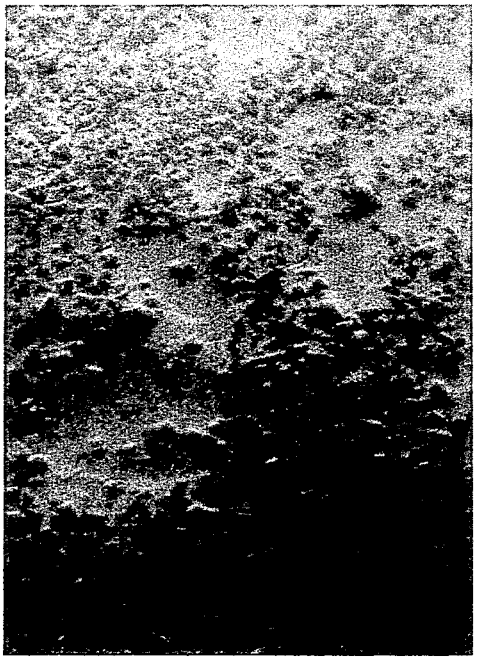
Figure 2B:
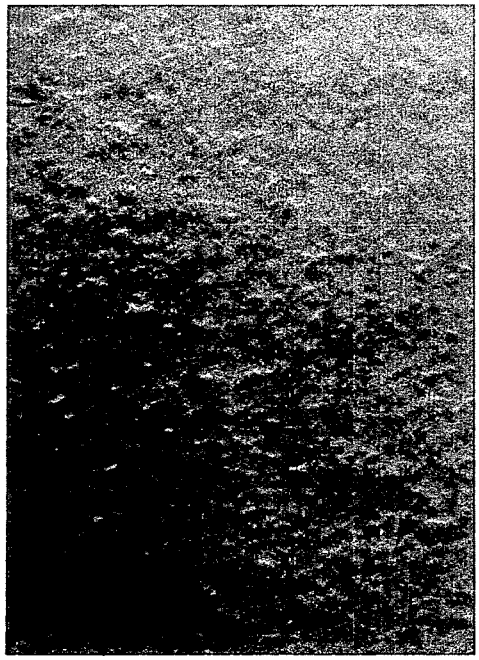

4. The grade powder is compacted into parts of the desired shape at pressures varying from 0.5 to 2 tons per square centimeter, the compacts dewaxed under vacuum or hydrogen, and the dewaxed parts sintered to full density at temperatures less than 1285° C, but typically at 1255" for cemented WC, and 1150° C for cemented $(W_{.5}Mo_{.5})C$. Sintering temperature as a function of the MoC exchange is shown in FIG. 1.

5. The sintered compacts are then annealed using the annealing schedule for steels with similar composition as the binder phase in the cemented carbides.

In the batching of the gross composition, the iron must be unalloyed powder with a preferred average grain size from 5 to 8 micrometers, but not exceeding 40 1 micrometers. When desired as alloying additions, the only metallic impurities which may be present in alloyed form in appreciable quantities in the ingredient iron powder are cobalt and nickel. The presence of quantities of more than 0.2 weight percent vanadium and more than 1.5 weight percent chromium in alloyed form in the iron tends to result in porosity of the sintered parts as a result of surface oxide not reduced by action of carbon or hydrogen at presintering temperatures. Elemental chromium has very poor milling characteristics and always present surface oxides can cause severe porosity problems in the sintered alloys. Introduction of chromium into the binder phase should therefore always be in the form of preformed charbides, such as $Cr_3C_2$. Molybdenum, and tungsten, as well as molybdenum or tungsten carbides such as $Mo_2C$ and $W_2C$, can be added without detriment to the sintering behavior.

In contrast to tool steels, and for reasons set forth above, binder or carbide alloying with vanadium or vanadium carbide is not recommended for any of the compositions of the invention, although concentrations in amounts in the order of 1 percent by weight of the binder may be tolerated. Similarly, no beneficial effects are realized by additions of such other carbides such as TiC, HfC, NbC, and TaC.

In essence then, the chief carbide ingredient in the cemented carbide is tungsten carbide, which may contain up to a maximum of 50 mole percent, but preferably not more than 25 mole percent, molybdenum carbide in solid solution. The principal alloying elements in the binder phase are cobalt, nickel, chromium, molybdenum, tungsten, and carbon, other alloying additions being either inert or having an adverse effect on properties and performance.

Since the excess carbide phase does not undergo any metallurgical changes at subsolids temperatures, changes in the hardness and mechanical properties as a result of heat treatment of the sintered part are solely attributable to the alloying characteristics of the binder alloys. The alloying additions to the binder therefore assume a role which is identical to that of steel of identical gross composition.

The following Tables 1 and 2 list some of the gross compositions of steel binders and carbide alloys used in the batching of cemented carbide alloys and the following examples 1 through 4 are representative of the cemented carbide alloy components and the methods used in the fabrication of the composites of the invention. Representative microstructures and properties of the cemented carbide component of the composites of the invention are depicted in FIGS. 2 through 12.

Table 1.

Selected List of Gross Compositions of Ingredient Carbides Used in the Fabrication of Steel-Bonded Carbides

| CARBIDE DESIGNATION | GROSS COMPOSITION OF CARBIDE |
|---|---|
| A' | WC |
| B' | $(W_{.75}Mo_{.25})C$ |
| C' | $(W_{.50}Mo_{.50})C$ |

Table 1.-continued

| Selected List of Gross Compositions of Ingredient Carbides Used in the Fabrication of Steel-Bonded Carbides | |
|---|---|
| CARBIDE DESIGNATION | GROSS COMPOSITION OF CARBIDE |
| D' | $(W_{.95}V_{.05})C$ |
| E' | $(W_{.75}Mo_{.20}V_{.05})C$ |
| F' | $(W_{.75}V_{.25})C$ |
| G' | $(W_{.96}Ti_{.04})C$ |
| H' | $(W_{.96}Ta_{.04})C$ |
| I' | $(W_{.96}Hf_{.02}Nb_{.02})C$ |
| J' | $(W_{.98}Cr_{.02})C$ |

Table 2.

| Selected List of Compositions of Steel Binders Used in the Fabrication of Cemented Molybdenum-Tungsten-Based Monocarbides | |
|---|---|
| Steel Binder Designation | |
| A | $(Fe_{.959}Cr_{.027}Mo_{.014})C_{.025}$ |
| B | $(Fe_{.960}Cr_{.020}Mo_{.010}Ni_{.01})C_{.018}$ |
| C | $(Fe_{.9755}Cr_{.0085}Mo_{.010})C_{.009}$ |
| D | $(Fe_{.9683}Cr_{.0157}Mo_{.016})C_{.0187}$ |
| E | $(Fe_{.92}Cr_{.040}Mo_{.020}Ni_{.020})C_{.0407}$ |
| F | $(Fe_{.9355}Cr_{.0375}Mo_{.017}Ni_{.010})C_{.025}$ |
| G | $(Fe_{.940}Cr_{.030}Mo_{.020}Ni_{.010})C_{.0215}$ |
| H | $(Fe_{.940}Cr_{.030}Mo_{.020}Ni_{.010})C_{.0677}$ |
| I | $(Fe_{.9363}Cr_{.025}Mo_{.025}Ni_{.0137})C_{.032}$ |
| J | $(Fe_{.9363}Cr_{.025}Mo_{.025}Ni_{.0137})C_{.0292}$ |
| K | $(Fe_{.89}Cr_{.025}Mo_{.025}Ni_{.050})C_{.0250}$ |
| L | $(Fe_{.90}Cr_{.025}Mo_{.025}Co_{.05})C_{.0291}$ |
| M | $(Fe_{.89}Cr_{.025}Mo_{.025}Co_{.05}Ni_{.01})C_{.0291}$ |
| N | $(Fe_{.865}Cr_{.025}Mo_{.025}Co_{.075}Ni_{.01})C_{.0291}$ |
| O | $(Fe_{.930}Cr_{.035}W_{.015}Ni_{.020})C_{.030}$ |
| P | $(Fe_{.9363}Cr_{.025}W_{.025}Ni_{.0137})C_{.0292}$ |
| Q | $(Fe_{.89}Cr_{.025}W_{.025}Co_{.05}Ni_{.01})C_{.0291}$ |
| R | $(Fe_{.865}Cr_{.045}Mo_{.025}Co_{.050}Ni_{.015})C_{.0300}$ |
| S | $(Fe_{.893}Cr_{.0836}Mo_{.0079}V_{.0154})C_{.080}$ |
| T | $(Fe_{.796}Cr_{.045}Mo_{.059}W_{.005}V_{.015}Co_{.08})C_{.055}$ |
| U | $(Fe_{.882}Cr_{.0448}Mo_{.0515}V_{.0217})C_{.0421}$ |
| V | $(Fe_{.8771}Cr_{.0485}Mo_{.0313}W_{.0207}V_{.0224})C_{.0560}$ |
| W | $(Fe_{.7919}Cr_{.0555}W_{.0413}V_{.0597}Co_{a\ .051})C_{.089}$ |

EXAMPLE 1

Gross Composition: (Binder alloy J + carbide alloy A')

0.27 moles WC + .73 moles $Fe_{.9363}Cr_{.025}Mo_{.025}Ni_{.0137})C_{.0292}$

A powder mixture consisting of 55.9 weight percent tungsten carbide, 1.158 weight percent chromium carbide, $Cr_3C_2$, 1.967 weight percent $Mo_2C$, .621 weight percent nickel and one-half of the amount of the balance of 4.354 weight percent iron are charged into a ball mill containing tungsten carbide balls as grinding media and naphta as milling fluid. After premilling for 20 hours, the remaining half of the iron powder is added and milling continued for an additional 60 hours to achieve the desired degree of comminution and homogenization of the powder mixture. Approximately one hour prior to mill shutdown, approximately 2.2 percent paraffine by weight of the dry powder mass is added to the powder slurry. The milled powder slurry is then separated from the grinding media, dried and homogenized in a high speed mechanical blender. The dry powder mass is then precompacted at a pressure of approximately 0.2 tons per square centimeter and granulated to yield agglomerated grains within a size range from 250 to 1000 micrometers. The granulated powder is pressed at a pressure of 1.5 tons per square centimeter into parts and dewaxed in a 3 hour cycle at 350° C under vacuum. The dewaxed compacts are presintered for approximately 1 hour at 1050° to 1150° C and sintered for 1 hour and 30 minutes at 1258° C under vacuum or hydrogen. Following sintering, the temperature of the furnace is lowered to 1000° C within a 30 minute period and the furnace then cooled at a rate of 15° C per minute until a temperature of 600° C is reached, after which the furnace is shut down.

Micrographic examination of the sintered alloy showed grains of tungsten monocarbide uniformly dispersed in a pearlitic steel matrix and the cemented carbide alloy had a Rockwell C hardness of 53.

Figure 3:
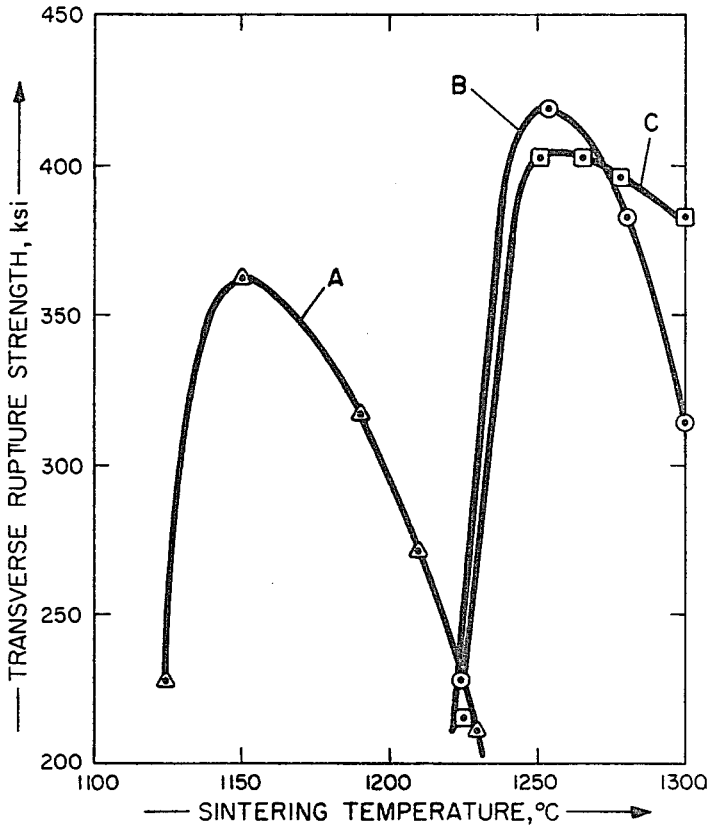
Figure 4:
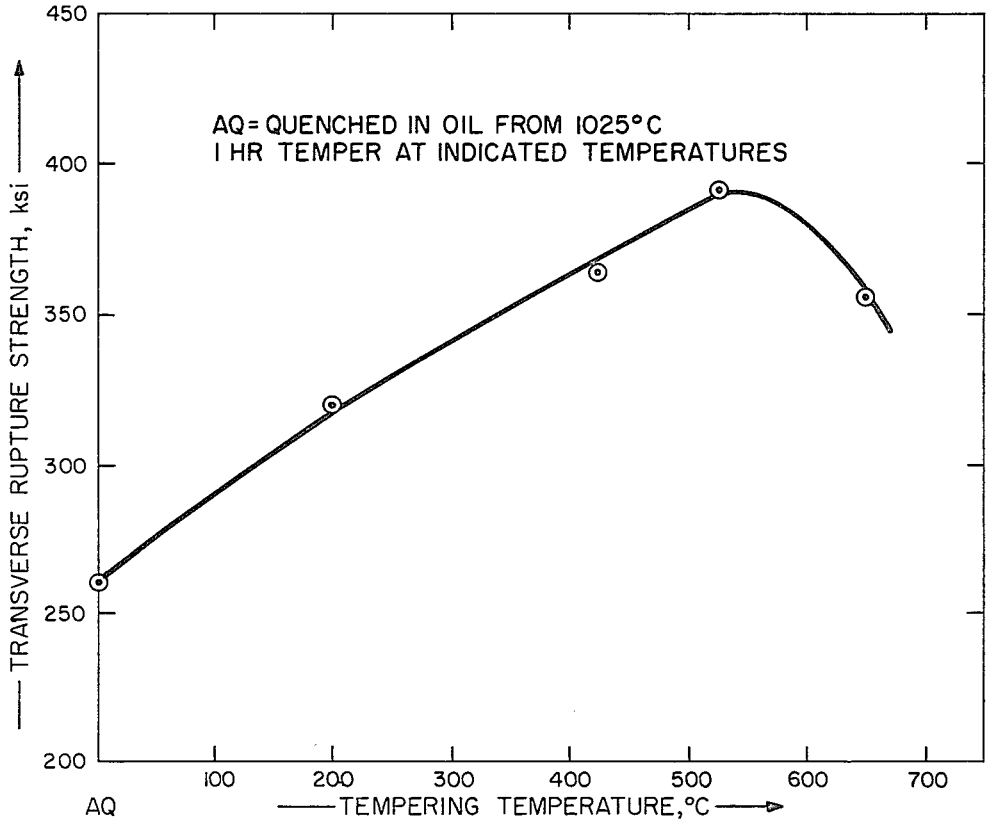
Figure 5:
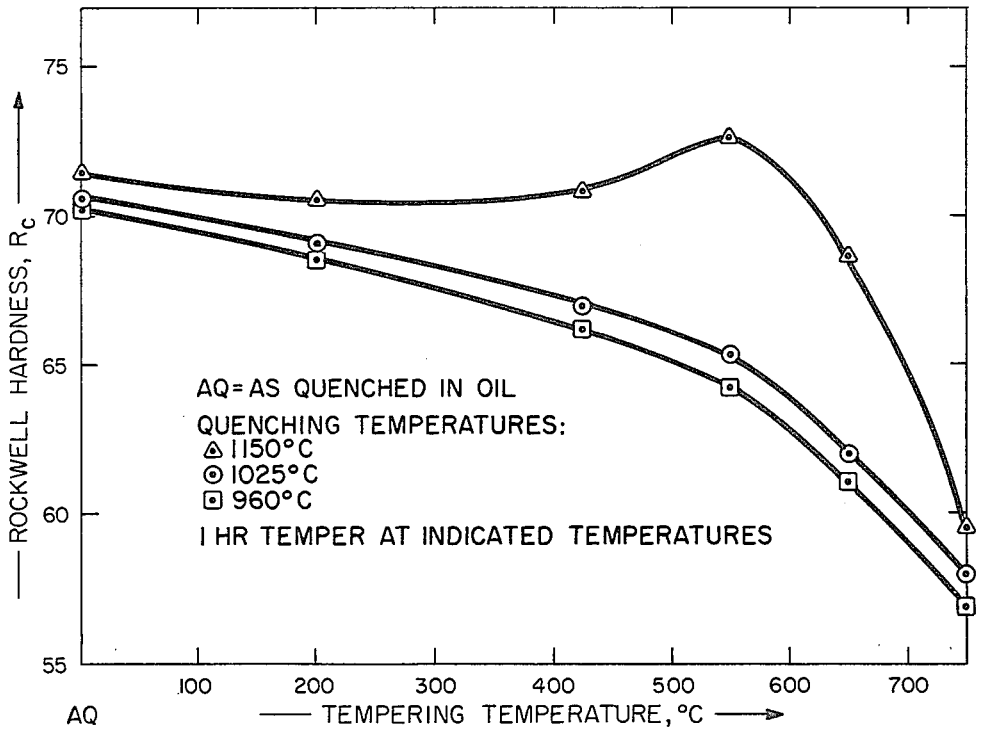
FIG. 5 is a graphical presentation of the Rockwell C hardness of a steel-bonded tungsten carbide alloy as a function of the quenching temperature and tempering treatment, the carbide having a gross composition .33 moles WC and .67 moles $(Fe_{.94}Cr_{.025}Mo_{.025})C_{.030}$.
Figure 6:
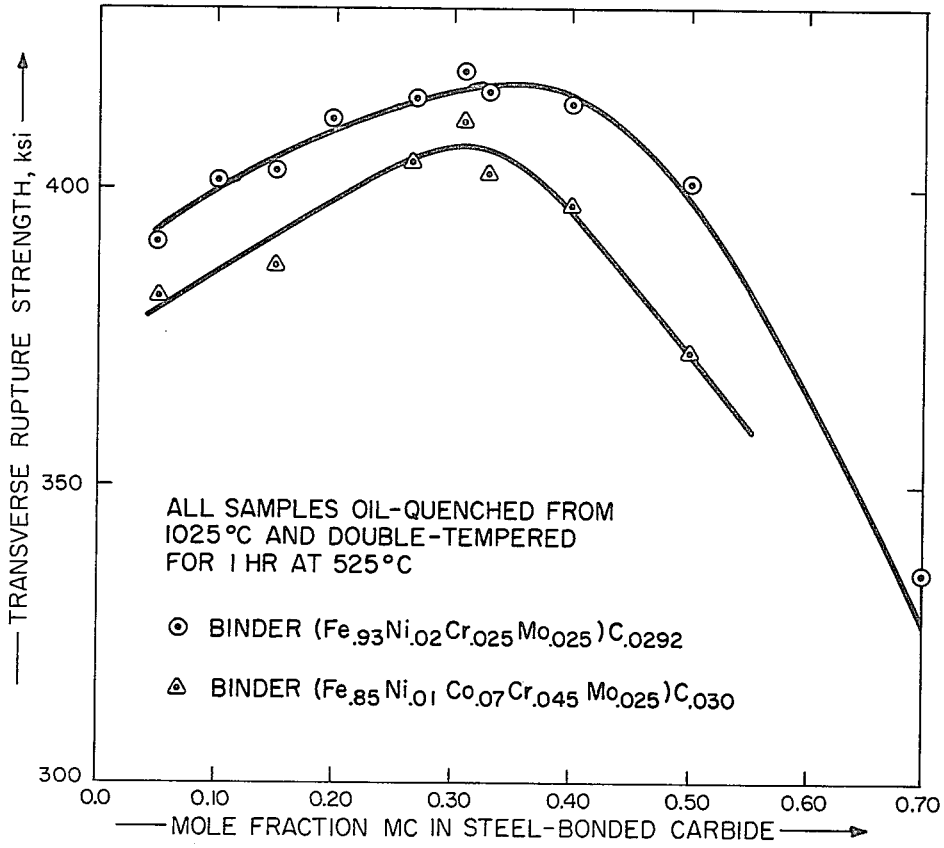
FIG. 6 is a graphical presentation of the transverse rupture strengths of a steel-bonded tungsten carbide as a function of the carbide content.
Figure 7:
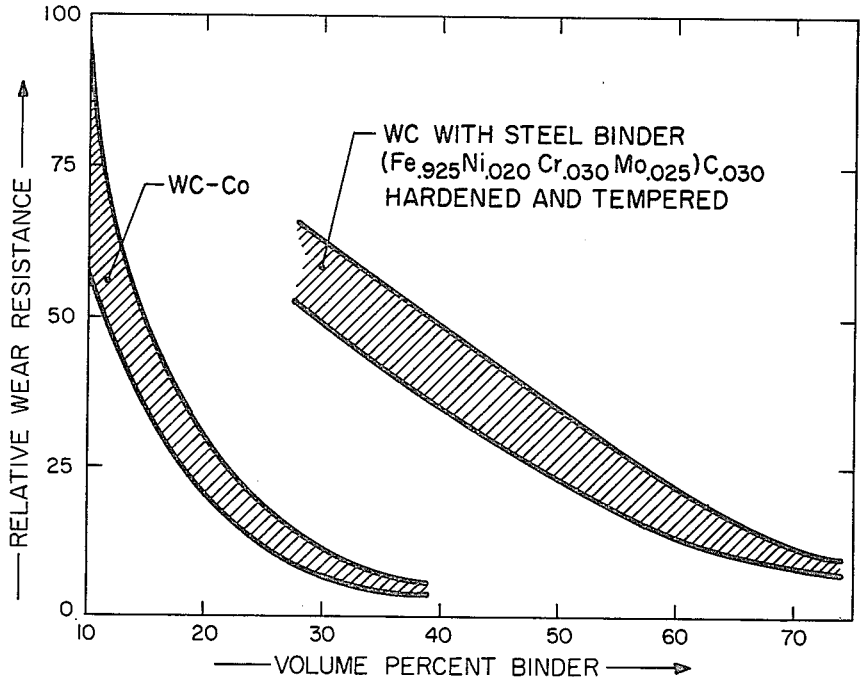
FIG. 7 is a graphical presentation of the relative wear resistance against an $Al_2O_3$ abrasive of commercial WC-Co cemented tungsten carbides and of steel-bonded tungsten carbide as a function of the binder content.

The sintered and process-annealed carbide, when austenitized at 960° C and quenched in oil, had a Rockwell C ($R_c$) hardness of 69 when tempered for 2 hours at 200° C, and $R_c$ = 64 following a one hour temper at 550° C. The same alloy when ausformed for 1 hour at 280° C following a 1 hour austenitizing treatment at 1000° C was $R_c$ 70.5. Austenitization at 1150° C resulted in an as-quenched hardness of $R_c$ 70 and a maximum hardness of $R_c$ 72 following a double temper of 1 hour each at 550° C. The values for the transverse rupture strengths given for a similar alloy in the graph of FIG. 3 are also representative for this composition.

EXAMPLE 2

(Binder alloy R + carbide alloy A') Gross Composition: 0.33 moles WC and .67 moles $(Fe_{.865}Cr_{.045}Mo_{.025}Co_{.050}Ni_{.015})C_{.030}$ A powder mixture consisting of 62.74 weight percent WC, 1.76 weight percent $Cr_3C_2$, 1.56 weight percent Mo, 1.92 weight percent Co, 0.58 weight percent Ni, and 31.44 weight percent iron are processed in the same manner as described under Example 1 and the powder compacts sintered for 1 hour and 30 minutes at 1268° C under vacuum. The sintered alloy was process-annealed by cooling at a rate of 12° C per hour through the range from 1050° C to 600° C, after which it had a measured room temperature hardness of $R_c$ = 51.

Austenitizing of the process-annealed cemented carbide for 1 hour at 1150° C, followed by water quenching and a double temper for 1 hour each at 550° C resulted in a hardness of $R_c$ 73.5. The measured transverse rupture strength was 410 ksi.

EXAMPLE 3

Gross Composition: 0.33 moles $(Mo_{.5}W_{.5}C$+.67 moles $(Fe_{.95}Cr_{.0323}Mo_{.0177})C_{.0215}$ A powder mixture consisting of 56.89 weight percent of the prealloyed carbide $(Mo_{.5}W_{.5})C$, 1.47 weight percent $Cr_3C_2$, 1.30 weight percent molybdenum, and 40.34 weight percent iron are processed in the same manner as described under Example 1, sintered for 1 hour at 1155° C, and annealed under the same conditions as described under Example 2.

The hardness of the process-annealed alloy was $R_c$ 56. Austenitizing of the cemented carbide for 1 hour at 1100° C, followed by quenching in oil and a doubletemper of 2 hours each at 550° C yielded a hardness of $R_c$ 74.5 and a transverse rupture strength of 285 ksi.

EXAMPLE 4

Fabrication of a cemented carbide-steel composite part by ingegral casting

A melt of 4340 steel (0.40 weight percent C), .85 weight percent Si, .75 weight percent Cr, 1.80 weight percent Ni, .25 weight percent Mo, balance Fe) was prepared by induction melting in a ceramic crucible and poured at a temperature of 1550° C into a ceramic mold containing a process-annealed piece of the cemented carbide described under Example 1. The weight ratio of steel to carbide in the cast piece was 6:1. After processannealing of the composite part as described under Example 1, followed by austenitization of the part at 960° C, water-quenching, and tempering for 1 hour at 200° C, the steel component had a hardness of $R_c$48 and the cemented carbide component $R_c$68.6. The composite structure was then sectioned and shaped into a transverse rupture test sample. The measured rupture strength of the cemented carbide/4340 steel interface was 162 ksi. The ratio of wear-resistance of carbide to steel, determined as the ratio of volume loss according to the accepted Riley-Stokes method using $Al_2O_3$ abrasive, was 65.

By comparison, measured loss ratios of the same cemented carbide integrally cast into a digger tooth under actual service conditions in abrasive soil varied between 55 to 85.

Similar results have been obtained from other composite structures comprising cemented carbide components and castable low alloy steel components which are joined by being integrally cast, such as are shown in FIGS. 13, 14 and 15. Typical compositions of castable low alloy steels are from 0.3 to 3 weight percent chromium, 0.2 to 3 weight percent molybdenum and/or tungsten, 0 to 4 percent manganese, with the nickel and manganese combined being up to 5 weight percent, and from 0.15 to 0.80 weight percent carbon, but typically 0.25 weight percent carbon.

The role of the different alloying additions to the binder phase of the cemented carbide in terms of their effect upon alloy properties and integral castability can be summarized as follows:

1. Chromium in amounts up to 3 percent by weight of the binder improve hardenability of the cemented carbide, while higher concentrations caused a slight decrease in toughness without commensurate improvement in the heat treatment characteristics. Variations in the chromium content within the preferred concentration range of 1.8 percent to 4.5 percent did not have a noticeable effect on the interface bonding characteristics of the integrally cast parts.

2. Molybdenum in amounts up to 4.5 percent in the binder phase have a more pronounced effect on hardenability than the equivalent amount of tungsten, although the attainable strength levels are about equivalent. For a given relative carbon balance in the binder, molybdenum generally lowers the incipient melting temperatures of the cemented carbides, while they are raised by tungsten. Molybdenum-bearing alloys therefore generally require lower steel pouring temperatures than cemented carbides equivalently alloyed with tungsten.

3. Additions of nickel to the binder alloy noticeably improves the fracture toughness of the cemented carbide without affecting to any measurable degree the sintering characteristics of the cemented carbide. Extension of the austenite range to progressively lower temperatures with increasing nickel content requires longer holding times in the annealing treatments and nickel contents (> 6 percent by weight of the binder) can have an adverse effect on hardenability because of retained austenite.

4. As in the case with tool steels, cobalt additions in amounts of up to 8 percent by weight of the binder improves hot hardness of the composite at a slight decrease in fracture toughness and transverse rupture strength. Cobalt, and to a somewhat lesser degree, also nickel increases the temperature at which the carbide loses its shape as a result of melting, and thus lessens the control requirements for pouring temperatures in forming the integrally cast part.

5. The optimum range of carbon stoichiometry of the binder phase is dependent on the amount and nature of its constituents. If the binder composition is characterized by $$(M_xM'_y)C_z$$

M = iron group metals Fe, Co, Ni

M' = elements forming stable carbides such as Mo, W, Cr in which $x$ stands for the combined relative mole fractions of the iron group elements, and $y$ stands for the combined mole fractions of the carbide-forming elements, then the ratio $z/y$ should gall into the range from 0.45 to 1.20, but preferably between 0.50 and 0.75. High carbon contents of the binder ($z/y > 0.90$) at high levels of alloying additions, in particular of chromium and molybdenum ($y > .10$) adversely affects integral castability of the cemented carbide due to the high proportion of liquid phase formed at temperatures slightly above incipient melting.

The concentration of carbide in the cemented carbide alloy has a pronounced effect on integral castability inasmuch as the differential of the thermal expansion between the cemented carbide and the steel component increases with increased carbide loading, and the thoughness of the carbide also decreases. At higher carbide concentrations the maximum size of the cemented carbide parts of a given concentration which can be integrally cast in steel without delamination during heat treatment progressively decreases. Foundry experience and filed tests, have shown the most useful range to extend from about 35 volume percent to 60 volume percent monocarbide in the sintered alloy.

In some applications, such as the mining tool applications shown in FIG. 15, in which the carbide component is subjected only to compressional stresses, and not tensional stresses, it may be useful to provide a layer of brazing material having a thickness of from 50 to 250 micrometers between the carbide component and the steel component. Since the stresses during operation tend to drive the carbide into the steel rather than to attempt to tear the carbide from the steel, the direct diffusion bonding between the sintered carbide-binder and the steel is less important to provide tensile strength, and the brazing material provides a cushioning layer between the components to help absorb impact energy while the tool is in use. Preferably the brazing material is a nickel or copper base alloy with a melting temperature between 1050° C and 1300° C. FIGS. 11 and 12 show micrographs of such structures.

The data shown in the tables and graphs are representative of many other alloys within the range of the invention which were prepared and tested. It becomes evident from a comparison of the wear performance of composites formed by integral casting of the carbide component in steel, that the composites of the invention offer a substantial improvement in cost performance of the cemented carbides of the state of the art designed for similar applications. It is intended that the invention be limited only by the appended claims.

I claim:

1. A heat treatable composite structure comprising a heat treatable cemented carbide component and a heat treatable steel component;

the cemented carbide component comprising a sintered component including grains of monocarbide based substantially on the hexagonal solid solution (Mo,W)C embedded in a binder of heat treatable steel alloy, the binder being from 30 to 80 percent by volume of the cemented carbide component;

the steel component being formed from a castable low alloy steel;

the cemented carbide component being joined to the steel component by being integrally cast into the steel component, the cemented carbide component thereby being diffusion bonded to the steel component and being prestressed in compression.

2. A composite structure according to claim 1 in which the molybdenum carbide content in the solid solution (Mo,W)C in the cemented carbide component is less than 50 mole percent, but preferably less than 25 mole percent.

3. A composite structure according to claim 1 in which the combinded amounts of tungsten and molybdenum monocarbide comprise more than 96 mole percent of the ingredient carbides of the cemented carbide component.

4. A composite structure according to claim 1 in which the binder in the cemented carbide component contains between 0.40 and 8.0 percent by weight chromium, between 0.40 and 8.0 percent by weight of a metal selected from the group consisting of molybdenum and tungsten, less than 1.5 percent by weight vanadium, and between 0.15 and 1.20 percent by weight carbon.

5. A composite structure according to claim 1 in which the cemented carbide component is coated with a 50 to 250 micrometer thick layer of nickel or copper base brazing alloy with a melting temperature between 1050° and 1300° C prior to integrally casting the cemented carbide component in steel.

6. A composition of material comprising sintered carbide-binder metal alloys in which the carbide comprises grains of monocarbide based substantially on the hexagonal solid solution (Mo,W)C embedded in a binder of heat treatable steel alloy which contains between 0.40 and 8.0 percent by weight chromium, between 0.40 and 8.0 percent by weight of a metal selected from the group consisting of molybdenum and tungsten, less than 1.5 percent by weight vanadium and between 0.15 and 1.20 percent by weight carbon, with the binder metal being from 30 to 80 percent by volume of the composition of material.

7. The composition of material of claim 6 in which the molybdenum carbide content of the solid solution (Mo,W)C is less than 50 mole percent of the solid solution.

8. The composition of material of claim 6 in which the molybdenum carbide content of the solid solution (Mo,W)C is less than 25 mole percent of the solid solution.

9. The composition of material of claim 6 in which the combinded amounts of tungsten and molybdenum monocarbide comprises more than 96 mole percent of the carbides in the composition of material.

10. The method of making a composition of material comprising sintered carbide-binder metal alloys in which the carbide comprises grains of monocarbide based substantially on a preselected hexagonal solid solution (Mo,W)C embedded in a binder of heat treatable steel alloy which contains between 0.40 and 8.0 percent by weight chromium, between 0.40 and 8.0 percent by weight of a metal selected from the group consisting of molybdenum and tungsten less than 1.5 percent by weight vanadium and between 0.15 and 1.20 percent by weight carbon, with the binder metal being from 30 to 80 percent by volume of the composition of material, which method comprises the steps of:

preparing a powder mixture of binder and carbides having the desired gross composition in which the binder portion of the powder mixture comprises iron powder whose average diameter is less than 40 micrometers alloyed with up to 10 percent by weight other iron group elements and not more than 0.2 percent by weight vanadium and 1.5 percent by weight chromium, with any additional chromium and vanadium being added to the powder mixture as carbides and with molybdenum and tungsten components of the binder being added as elemental powders or carbides, wet milling the powder mixture to increase the sintering activity of the iron powder, drying and homogenizing the powder mixture, pressing the powder mixture into compacts having the desired shapes, and sintering the compacts to substantially full density at sintering temperatures not higher than the temperature at which $\eta$-carbides are formed for the preselected solid solution (Mo,W)C.

11. The method of claim 10 in which the sintering temperature is within the range shows in FIG. 1 for the preselected solid solution (Mo,W)C.

12. The method of claim 10 in which the average diameter of the iron powder is less than 10 micrometers.

13. The method of making a heat treatable composite structure comprising a heat treatable cemented carbide component and a heat treatable steel component in which the cemented carbide component comprises grains of monocarbide based substantially on a preselected hexagonal solid solution (Mo,W)C embedded in a binder of heat treatable steel alloy which contains between 0.40 and 8.0 percent by weight chromium between 0.40 and 8.0 percent by weight of a metal selected from the group consisting of molybdenum and tungsten less than 1.5 percent by weight vanadium and between 0.15 and 1.20 percent by weight carbon, with the binder metal being from 30 to 80 percent by volume of the composition of material, and in which the steel component is formed from a castable low alloy steel, which method comprises the steps of:

preparing a powder mixture of binder and carbides having the desired gross composition of the cemented carbide component in which the binder portion of the powder mixture comprises iron powder whose average diameter is less than 40 micrometers alloyed with up to 10 percent by weight other iron group elements and not more than 0.2 percent by weight vanadium and 1.5 percent by weight chromium, with any additional chromium and vanadium being added to the powder mixture as carbides and with molybdenum and tungsten components of the binder being added as elemental powders or carbides, wet milling the powder mixture to increase the sintering activity of the iron powder, drying and homogenizing the powder mixture, pressing the powder mixture into a compact having a predetermined shape, sintering the compact to substantially full density at sintering temperatures not higher than the temperature at which $\eta$-carbides are formed for the preselected solid solution (Mo,W)C, placing the sintered compact in a predetermined location of a casting mold, pouring molten low alloy steel into the mold, and allowing the molten steel to solidify, whereby a composite structure is formed in which the cemented carbide component is integrally bonded to the steel component and the cemented carbide component is prestressed in compression.

* * * * *